US010815842B2

(12) United States Patent
Burke et al.

(10) Patent No.: US 10,815,842 B2
(45) Date of Patent: Oct. 27, 2020

(54) CAMSHAFT PHASER ARRANGEMENT FOR A CONCENTRIC CAMSHAFT ASSEMBLY

(71) Applicant: Schaeffler Technologies AG & Co. KG, Herzogenaurach (DE)

(72) Inventors: Steven Burke, Fort Gratiot, MI (US); Dan Zehan, Windsor (CA)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/227,328

(22) Filed: Dec. 20, 2018

(65) Prior Publication Data

US 2020/0200053 A1 Jun. 25, 2020

(51) Int. Cl.

*F01L 1/344* (2006.01)
*F01L 1/352* (2006.01)
*F01L 1/047* (2006.01)

(52) U.S. Cl.

CPC ..... *F01L 1/34413* (2013.01); *F01L 1/3442* (2013.01); *F01L 1/352* (2013.01); *F01L 2001/0473* (2013.01); *F01L 2001/34489* (2013.01)

(58) Field of Classification Search

CPC ..... F01L 1/34413; F01L 1/3442; F01L 2001/34489; F01L 2001/0473; F01L 1/352
USPC ..... 123/90.17
See application file for complete search history.

(56) References Cited

U.S. PATENT DOCUMENTS 5,417,186 A * 5/1995 Elrod ..... F01L 1/02 123/90.17
6,725,817 B2 4/2004 Methley et al.
7,444,968 B2 * 11/2008 Lancefield ..... F01L 1/022 123/90.17
7,841,311 B2 11/2010 Hutcheson et al.
8,051,818 B2 * 11/2011 Myers ..... F01L 1/3442 123/90.17
9,080,474 B2 7/2015 Wigsten et al.
9,249,695 B2 * 2/2016 Burke ..... F01L 1/352
2006/0278188 A1 * 12/2006 Payne ..... F01L 1/344 123/90.17
2010/0089353 A1 4/2010 Myers et al.
2010/0186698 A1 7/2010 Pluta
2014/0076252 A1 * 3/2014 Burke ..... F01L 1/352 123/90.17

FOREIGN PATENT DOCUMENTS

DE 102009041755 A1 4/2010
WO 2017042302 A1 3/2017

OTHER PUBLICATIONS

Zehan, U.S. Appl. No. 16/193,140, filed Nov. 16, 2018.
Kandolf et al., U.S. Appl. No. 62/676,709, filed May 25, 2018.
Shamie et al., U.S. Appl. No. 16/193,122, filed Nov. 16, 2018.

* cited by examiner

*Primary Examiner* — Patrick Hamo
*Assistant Examiner* — Wesley G Harris
(74) *Attorney, Agent, or Firm* — Matthew V. Evans

(57) ABSTRACT

A camshaft phaser arrangement configured for a concentric camshaft assembly having inner and outer camshafts is provided. The camshaft phaser arrangement includes a first camshaft phaser that is configured to be non-rotatably connected to both the inner and outer camshafts, and a second camshaft phaser that is configured to be non-rotatably connected to one of the inner or outer camshafts.

10 Claims, 4 Drawing Sheets

CAMSHAFT PHASER ARRANGEMENT FOR A CONCENTRIC CAMSHAFT ASSEMBLY

TECHNICAL FIELD

Example aspects described herein relate to camshaft phasers, and, more particularly, to camshaft phasers utilized within an internal combustion (IC) engine having a concentric camshaft assembly.

BACKGROUND

Camshaft phasers are utilized within IC engines to adjust timing of an engine valve event to modify performance, efficiency and emissions. Hydraulically actuated camshaft phasers can be configured with a rotor and stator arrangement. The rotor can be attached to a camshaft and actuated hydraulically in clockwise or counterclockwise directions relative to the stator to achieve variable engine valve timing. Electric camshaft phasers can be configured with a gearbox and an electric motor to phase a camshaft to achieve variable engine valve timing.

Many different camshaft configurations are possible within an IC engine. Some camshaft configurations include an intake camshaft that only actuates intake valves, and an exhaust camshaft that only actuates exhaust valves; such camshaft configurations can often simplify efforts to independently phase the intake valve events separately from the exhaust valve events. Other camshaft configurations can utilize a single camshaft to actuate both intake and exhaust valves; however, a single camshaft configured with both intake and exhaust lobes proves difficult to provide independent phasing of the intake and exhaust valves. For single camshaft configurations, a concentric camshaft assembly can be implemented that utilizes an inner camshaft and an outer camshaft, each arranged with one of either exhaust lobes or intake lobes, with each of the camshafts having a designated camshaft phaser to vary the respective engine valve timing.

One known camshaft phaser arrangement for a concentric camshaft assembly includes a first and a second camshaft phaser that are stacked coaxially at an end of the concentric camshaft assembly. However, this coaxial stacking can be difficult to package within some IC engine applications. A solution is needed that minimizes axial packaging space while maintaining optimal functionality of the camshaft phaser arrangement.

SUMMARY

A camshaft phaser arrangement configured for a concentric camshaft assembly having inner and outer camshafts is provided. The camshaft phaser arrangement includes a first camshaft phaser that is configured to be non-rotatably connected to both the inner and outer camshafts, and a second camshaft phaser that is configured to be non-rotatably connected to one of the inner or outer camshafts.

At least one of the first or second camshaft phaser can be an electric camshaft phaser or a hydraulic camshaft phaser. Furthermore, the second camshaft phaser can be a hydraulic camshaft phaser, with the first camshaft phaser arranged axially outward of the second camshaft phaser; or, the first camshaft phaser can be an electric camshaft phaser, with the first camshaft phaser arranged axially outward of the second camshaft phaser.

The first camshaft phaser can include at least one first phased component that is configured to be non-rotatably connected to the other of the inner or outer camshafts. In one aspect, the at least one phased component can include an output gear configured to be non-rotatably connected to the other of the inner or outer camshafts. In a further aspect, the first camshaft phaser includes at least one follower component that is non-rotatably connected to the one of the inner or outer camshafts. The at least one follower component can include a rotary stop disk that cooperates with the output gear to provide a range of authority for the first camshaft phaser. In another aspect, the at least one follower component can include a gearbox housing that is non-rotatably connected to the one of the inner or outer camshafts. The gearbox housing can include threads that are configured to engage threads on the one of either the inner or outer camshafts.

In an example embodiment, the second camshaft phaser comprises at least one second phased component that is configured to be non-rotatably connected to the one of the inner or outer camshafts; in one aspect, the second camshaft phaser further comprises at least one second non-phased component that includes a drive wheel configured with a power transmission interface. The at least one second phased component can include a timing wheel and/or a hydraulically actuated rotor.

In an example embodiment, a camshaft phaser arrangement configured for a concentric camshaft assembly having inner and outer camshafts is provided that comprises a first camshaft phaser and a second camshaft phaser. The first camshaft phaser includes at least one first phased component configured to be non-rotatably connected to the inner camshaft, and at least one follower component configured to be non-rotatably connected to the outer camshaft. The second camshaft phaser includes at least one second non-phased component, and at least one second phased component configured to be non-rotatably connected to the outer camshaft. In one aspect, the first and second camshaft phasers are hydraulic phasers; the at least one first phased component includes a first rotor; the at least one follower component includes a first stator; the at least one second phased component includes a second rotor; and, the at least one second non-phased component includes a second stator. In another aspect, the first camshaft phaser is an electric camshaft phaser and the second camshaft phaser is a hydraulic camshaft phaser. The at least one second phased component can include a hydraulically actuated rotor, and the at least one follower component can include a gearbox housing. The inner camshaft can be connected to intake lobes and the outer camshaft can be connected to exhaust lobes.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
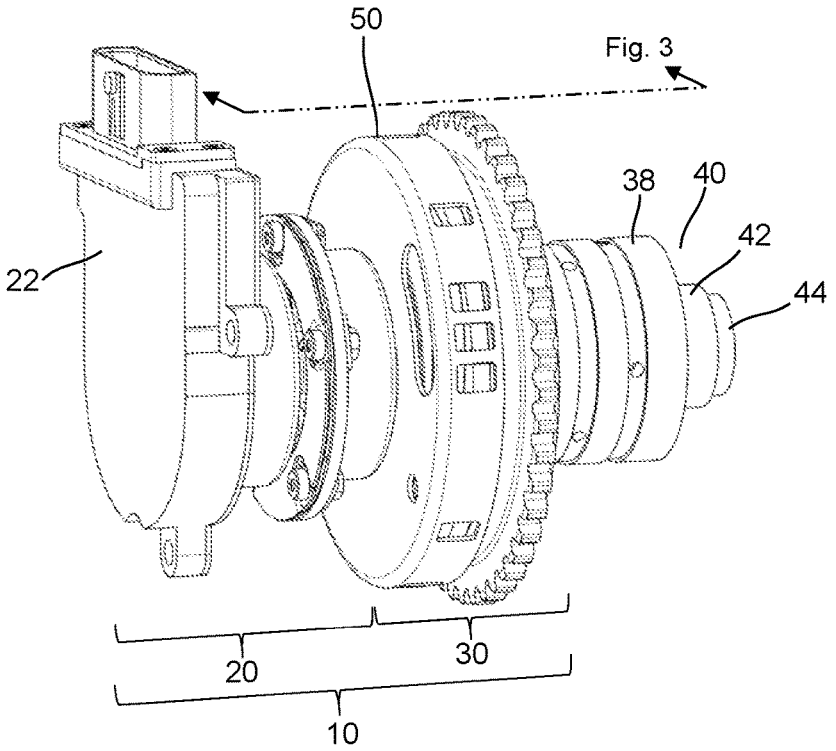
FIG. 1 is a perspective view of a camshaft phaser arrangement for a concentric camshaft assembly that includes a first camshaft phaser and a second camshaft phaser.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Figure 2:
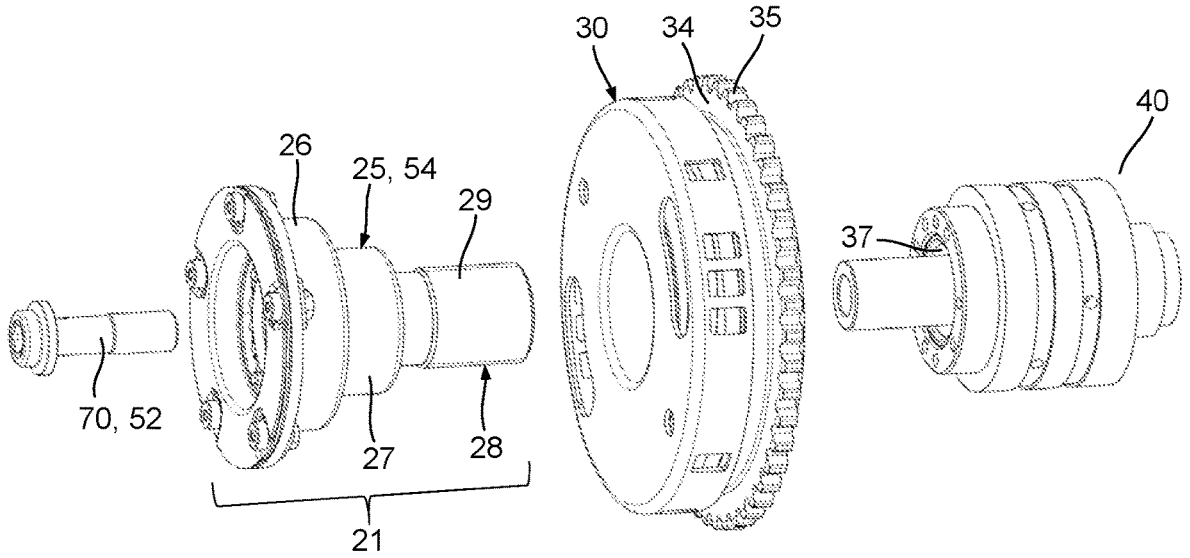
FIG. 2 is an exploded perspective view of the camshaft phaser arrangement and concentric camshaft assembly of FIG. 1 without an electric motor.
Figure 3:
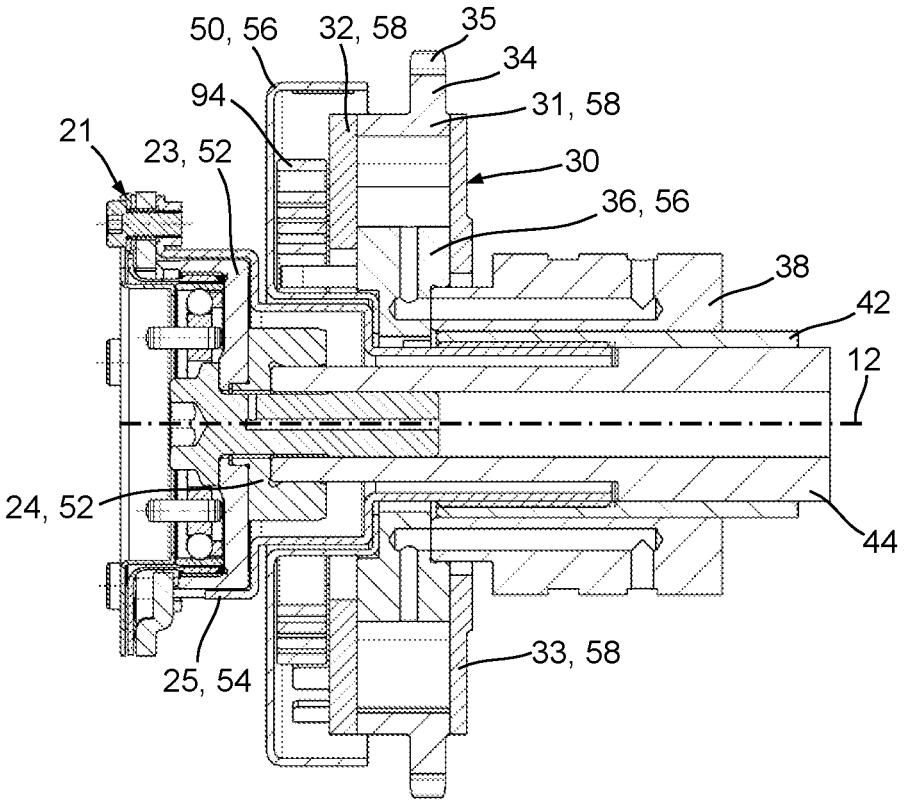
FIG. 3 is a cross-sectional view taken from FIG. 1.
Figure 4:
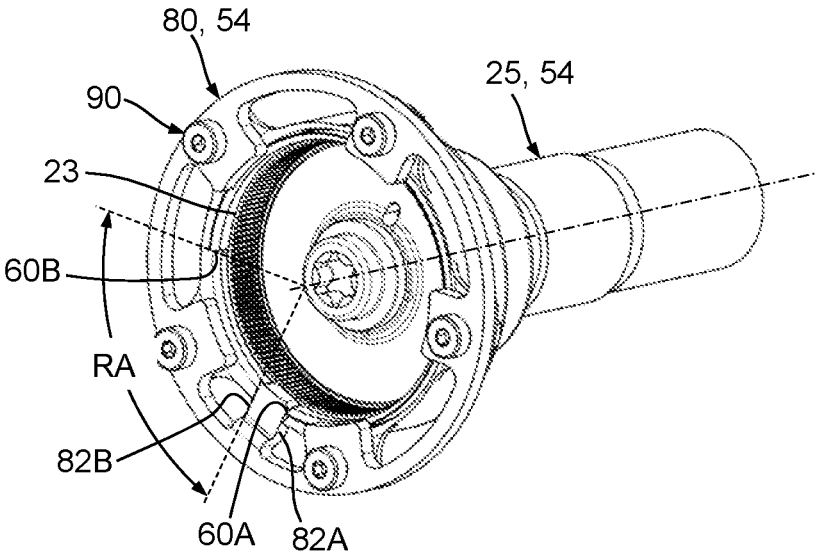
FIG. 4 is a perspective view of a portion of the first camshaft phaser of FIG. 1.

Referring to FIG. 1, a perspective view of an example embodiment of a camshaft phaser arrangement 10 for a concentric camshaft assembly 40 is shown that includes a first camshaft phaser 20 and a second camshaft phaser 30. FIG. 2 shows an exploded perspective view of the camshaft phaser arrangement 10 and concentric camshaft assembly 40 of FIG. 1 without an electric motor 22 for clarity purposes. FIG. 3 shows a cross-sectional view taken from FIG. 1. FIG. 4 shows a perspective view of a portion of the first camshaft phaser 20 of FIG. 1. The following discussion should be read in light of FIGS. 1 through 4. The camshaft phaser arrangement 10 includes a rotational axis 12, a first camshaft phaser 20, and a second camshaft phaser 30. The first camshaft phaser 20 is arranged axially adjacent to the second camshaft phaser 30 such that the first camshaft phaser 20 is axially outward of the second camshaft phaser 30. Additionally, the first camshaft phaser 20 can be concentric with the second camshaft phaser 30, as shown. The concentric camshaft assembly 40 includes an outer camshaft 42 and an inner camshaft 44. The first camshaft phaser 20 is an electric camshaft phaser, actuated by an electric motor 22, and the second camshaft phaser 30 is a hydraulic camshaft phaser, actuated by hydraulic fluid; however, the first and second camshaft phasers 20, 30 could both either be electric camshaft phasers or hydraulic camshaft phasers; furthermore, the positions of the first and second camshaft phasers 20, 30 could be switched, such that the second camshaft phaser 30 (hydraulic) is axially outward of the first camshaft phaser 20 (electric). In summary, the first and second camshaft phasers 20, 30 can include at least one of a hydraulic camshaft phaser or an electric camshaft phaser.

The first camshaft phaser 20 includes an electric motor 22 and a gearbox assembly 21. The gearbox assembly 21 includes an outer housing 25, an output gear 23, and a rotary stop disk 80. The rotary stop disk 80 is connected to the outer housing 25 via a plurality of disk fasteners 90. The second camshaft phaser 30 includes a rotor 36, a stator 31, a bias spring 94, a front cover 32, a rear cover 33, a drive wheel 34, and a timing wheel 50. A description of how each of these components of the first and second camshaft phasers 20, 30 connect with each other and with the inner and outer camshafts 44, 42 of the concentric camshaft assembly 40 now follows.

When describing the associated component connections, the terms "phased", "non-phased", and "non-rotatably connected" will be used. Camshaft phasers function to vary a timing of an occurrence of a valve event of an IC engine relative to a piston position; or, stated otherwise, since a rotary or angular position of a crankshaft determines piston position, camshaft phasers function to vary the valve timing relative to a crankshaft position. This is often termed "phasing" of the valve event and its purpose is to vary the performance or exhaust emissions of an IC engine. As most IC engines utilize a camshaft with lobes to actuate its valves, camshaft phasers function to vary the relative angular position of the camshaft relative to the angular position of the crankshaft. Phasing the camshaft can, for example: 1). Change the timing of an occurrence of the valve event so that it occurs earlier, often termed "advancing" a valve event, or 2). Change the timing of an occurrence of the valve event so that it occurs later, often termed "retarding" a valve event. Given this function description, a camshaft phaser can include "phased components" and "non-phased components." "Phased components" are those components that rotate in unison with the camshaft, while "non-phased components" are those components that rotate in unison with the crankshaft. The term "non-rotatably connected" can be used to help describe various connections of camshaft phaser components and is meant to signify two elements that are directly or indirectly connected in a way so that whenever one of the elements rotate, both of the elements rotate in unison, such that relative rotation between these elements is not possible. Radial and/or axial movement of non-rotatably connected elements with respect to each is possible, but not required.

For the example embodiment shown in FIGS. 1 through 4, the inner camshaft 44 is connected to the first camshaft phaser 20 via a first camshaft fastener 70. The first camshaft fastener 70 axially clamps the output gear 23 and a central hub 24 to the inner camshaft 44 such that the output gear 23 is non-rotatably connected to the inner camshaft 44. Additionally, the outer camshaft 42 is non-rotatably connected to the outer housing 25 of the first camshaft phaser 20; therefore, the first camshaft phaser 20 is non-rotatably connected to both the inner camshaft 44 and the outer camshaft 42. The outer housing 25 has a first section 26 that envelopes at least a portion of the output gear 23, a second section 27 that envelopes at least a portion of the central hub 24, and a third section 28 that extends through the second camshaft phaser 30 and connects with the outer camshaft 42. External threads 29 are formed on the third section 28 to engage with internal threads 37 of the outer camshaft 42. The attachment of the outer housing 25 also facilitates axial clamping of the rotor 36 and timing wheel 50 to the outer camshaft 42 via a journal bearing 38 that is non-rotatably connected to the outer camshaft 42. Therefore, in addition to the outer housing 25, the rotor 36 and timing wheel 50 are also non-rotatably attached to the outer camshaft 42. This fastening arrangement facilitates a reduced axial packaging space for the camshaft phaser arrangement 10. Various forms of connections between the outer housing 25 and outer camshaft 42 outside of a threaded connection are also possible. Additionally, it could also be desirable and possible to connect the inner camshaft 44 to the second camshaft phaser 30 and the outer camshaft 42 to the first camshaft phaser 20.

A rotational range of authority RA for a camshaft phaser is typically defined as the additive advance and retard phasing capability that the camshaft phaser can impart on a respective camshaft, relative to a piston top-dead-center (TDC) position. For example, in an instance where timing of an engine valve can be advanced to a maximum of −40 degrees of camshaft rotation relative to TDC and retarded to a maximum of +10 degrees of camshaft rotation relative to TDC, the range of authority is 50 degrees of camshaft rotation. The rotary stop disk 80 that is connected to the outer housing 25 provides a first rotational stop 82A and a second rotational stop 82B for the output gear 23; the output gear 23 is configured with a first stop abutment 60A and a second stop abutment 60B that interface with the first and second rotational stops 82A, 82B to provide a rotational range of camshaft phasing authority RA for the first camshaft phaser 20 relative to the second camshaft phaser 30 since the inner camshaft 44 is non-rotatably connected to the output gear 23 and the outer camshaft 42 is non-rotatably connected to the outer housing 25. For this example embodiment, the location of the first and second rotational stops 82A, 82B on the rotary stop disk 80 can change when the outer camshaft 42 is phased relative to the crankshaft by the second camshaft phaser 30. Therefore, the range of authority RA provided by the first and second rotation stops 82A, 82B of the rotary stop disk 80 and the respective first and second stop abutments 60A, 60B of the output gear 23 could also be used in combination with other mechanical or control software stops to manage a desired range of authority for the first camshaft phaser 20.

Figure 5A:
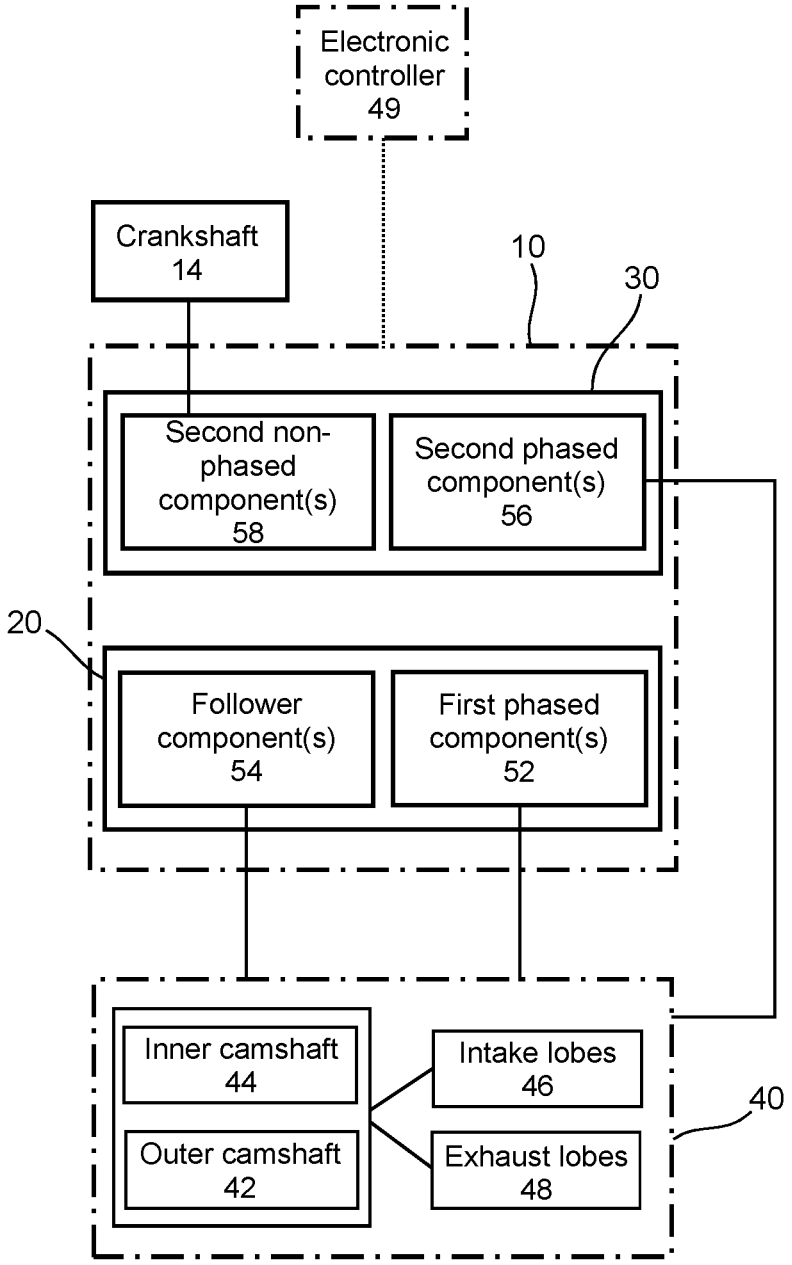
FIG. 5A is a schematic diagram of the camshaft phaser arrangement and concentric camshaft assembly of FIG. 1 together with an electronic controller, depicting a flexible location of intake and exhaust camshaft lobes within the concentric camshaft assembly.

FIG. 5A is a schematic representation of the previously described camshaft phaser arrangement 10 for the concentric camshaft assembly 40, controlled by an electronic controller 49. The electronic controller communicates electronically with the camshaft phaser arrangement 10 to phase the inner camshaft 44 and outer camshaft 42 of the concentric camshaft assembly 40. The electronic controller 49 can make phasing decisions based on IC engine sensor feedback, operating conditions, and desired IC engine performance. FIG. 5A categorizes components of the first camshaft phaser 20 and second camshaft phaser 30 into component classifications. For the first camshaft phaser 20 these component classifications include: first phased component(s) 52, and follower component(s) 54. For the second camshaft phaser 30 these component classifications include: second phased component(s) 56 and second non-phased component(s) 58. The element numbers for these respective component classifications 52, 54, 56, 58 are also applied to the applicable components within FIGS. 1 through 4. Therefore, for the first camshaft phaser 20, the output gear 23 and the central hub 24 reside within the "first phased component 52" classification; and, the outer housing 25 and rotary stop disk 80 reside within the "follower component 54" classification. Furthermore, for the second camshaft phaser 30, the rotor 36 and the timing wheel 50 reside within the "second phased component 56" classification; and, the stator 31, front cover 32, and rear cover 33 reside within the "second non-phased component 58" classification. For Figure clarity purposes, not all of the components of the first and second camshaft phasers 20, 30 are identified with the previously described component classifications.

The camshaft phaser arrangement 10 for the concentric camshaft assembly 40 provides independent phasing of the inner camshaft 44 relative to the outer camshaft 42. As shown in FIG. 5A, the concentric camshaft assembly 40 includes intake lobes 46 and exhaust lobes 48 that can be configured on either the inner camshaft 44 or the outer camshaft 42. For the described camshaft phaser arrangement 10, it may be advantageous to configure the inner camshaft 44 with intake lobes 46 and the outer camshaft 42 with exhaust lobes 48 to facilitate the intake valve events being controllably phased by the first camshaft phaser 20, which is shown as an electric camshaft phaser.

FIG. 5A illustrates multiple non-rotatable connections between the camshaft phaser arrangement 10 and the concentric camshaft assembly 40. Each non-rotatable connection is depicted by a solid connecting line between the respective components. As shown, both component classifications 52, 54 of the first camshaft phaser 20, as well as the second phased component(s) 56 of the second camshaft phaser 30, are all non-rotatably connected to the concentric camshaft assembly 40. The second non-phased component(s) 58 of the second camshaft phaser 30 is/are non-rotatably connected to a crankshaft 14. In the example embodiment shown in FIGS. 1 through 4, the second camshaft phaser 30 includes a drive wheel 34 with a power transmission interface 35. The power transmission interface 35 can engage with either a belt, chain, gear or any power transmission component that connects the second non-phased component(s) 58 to the crankshaft 14 or any other power source within an IC engine.

Figure 5B:
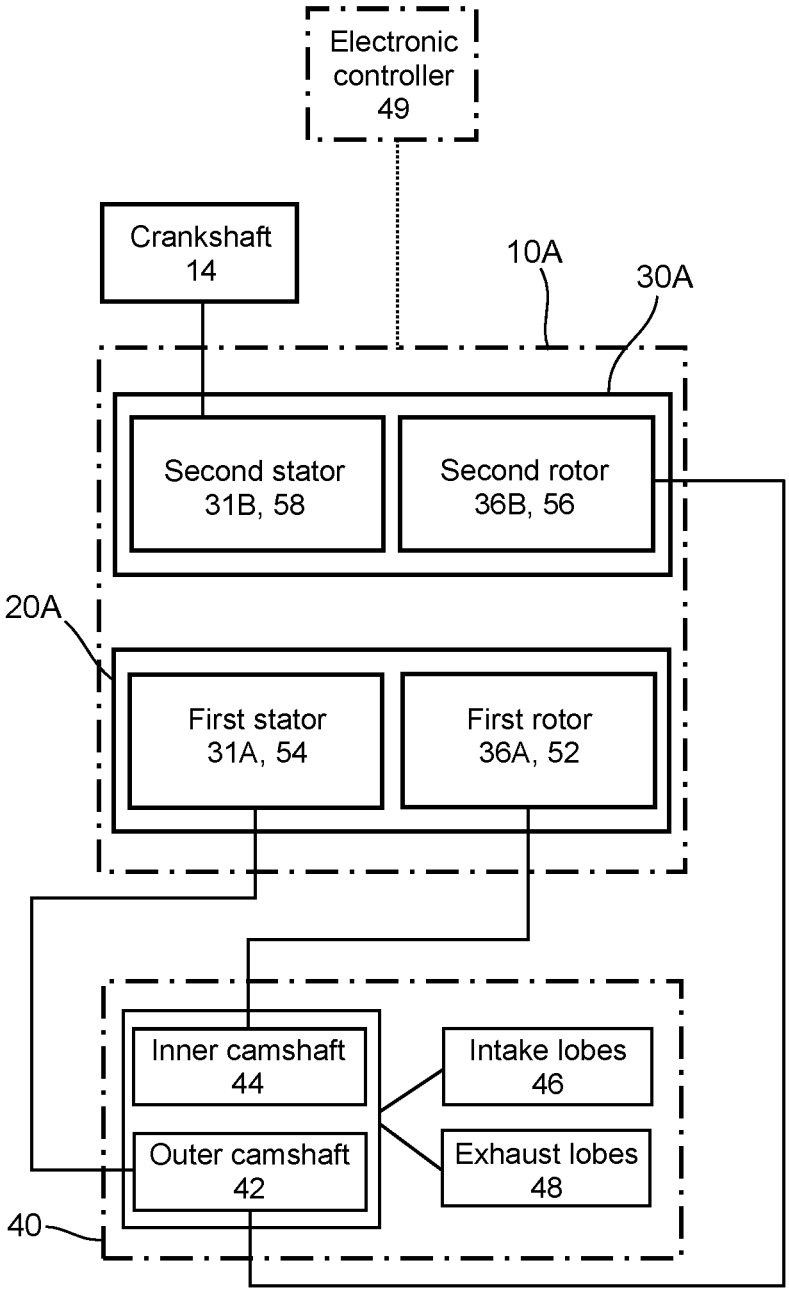
FIG. 5B is a schematic diagram of an example embodiment of a camshaft phaser arrangement for a concentric camshaft assembly with a first and a second hydraulically actuated camshaft phaser.

FIG. 5B shows a second example embodiment in schematic form of a camshaft phaser arrangement 10A that includes a first hydraulic camshaft phaser 20A and a second hydraulic camshaft phaser 30A. The first hydraulic camshaft phaser 20A includes a first rotor 36A and a first stator 31A; and, the second hydraulic camshaft phaser 30A includes a second rotor 36B and a second stator 31B. Per previously discussed definitions for first phased component(s) 52, follower component(s) 54, second phased component(s) 56, and second non-phased component(s) 58, the following discussion applies to the camshaft phaser arrangement 10A. The first rotor 36A can be classified as a first phased component 52 and the first stator 31A can be classified as a follower component 54. The second rotor 36B can be classified as a second phased component 56, and the second stator 31B can be classified as a second non-phased component 58. The camshaft phaser arrangement 10A depicted in FIG. 5B illustrates utilization of two hydraulic camshaft phasers instead of one hydraulic and one electric camshaft phaser.

FIG. 5B also illustrates multiple non-rotatable connections between the camshaft phaser arrangement 10A and the concentric camshaft assembly 40. Each non-rotatable connection is depicted by a solid connecting line between the respective components. With reference to the first hydraulic camshaft phaser 20A, the first rotor 36A (first phased component(s) 52) is non-rotatably connected to the inner camshaft 44, while the first stator 31A (follower component(s) 54) is non-rotatably connected to the outer camshaft 42. With reference to the second hydraulic camshaft phaser 30A, the second rotor 36B (second phased component(s) 56) is non-rotatably connected to the outer camshaft 42, while the second stator 31B (second non-phased component(s) 58) is non-rotatably connected to the crankshaft 14.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser arrangement configured for a concentric camshaft assembly having inner and outer camshafts, the camshaft phaser arrangement comprising:

a first electric camshaft phaser configured to be non-rotatably connected to both the inner and outer camshafts, the first electric camshaft phaser having a gearbox housing; and, a second camshaft phaser configured to be non-rotatably connected to one of the inner or outer camshafts; and, the gearbox housing configured to fasten a hydraulically actuated rotor of the second camshaft phaser to the one of the inner or outer camshafts.

2. The camshaft phaser arrangement of claim 1, wherein at least a portion of the first electric camshaft phaser extends through the second camshaft phaser.

3. The camshaft phaser arrangement of claim 1, wherein the first electric camshaft phaser is arranged axially outward of the second camshaft phaser.

4. The camshaft phaser arrangement of claim 1, wherein the first electric camshaft phaser further comprises an output gear configured to be non-rotatably connected to a remaining one of the inner or outer camshafts.

5. The camshaft phaser arrangement of claim 4, wherein the first electric camshaft phaser further comprises a rotary stop disk that cooperates with the output gear to provide a range of authority for the first electric camshaft phaser.

6. The camshaft phaser arrangement of claim 1, wherein the gearbox housing is non-rotatably connected to the one of the inner or outer camshafts.

7. The camshaft phaser arrangement of claim 1, wherein the gearbox housing includes threads configured to engage threads on the one of the inner or outer camshafts.

8. The camshaft phaser arrangement of claim 1, wherein the gearbox housing axially clamps the hydraulically actuated rotor to the one of the inner or outer camshafts.

9. The camshaft phaser arrangement of claim 8, wherein the gearbox housing axially clamps a timing wheel to the one of the inner or outer camshafts.

10. The camshaft phaser arrangement of claim 1, wherein the gearbox housing envelopes at least a portion of an output gear.

* * * * *